US011534011B2

(12) United States Patent
House et al.

(10) Patent No.: US 11,534,011 B2
(45) Date of Patent: Dec. 27, 2022

(54) SLEEPING BAG WITH EXPANSION PANEL

(71) Applicant: Big Agnes, Inc., Steamboat Springs, CO (US)

(72) Inventors: Sally House, Steamboat Springs, CO (US); William Gamber, Steamboat Springs, CO (US)

(73) Assignee: BIG AGNES, INC., Steamboat Springs, CO (US)

( * ) Notice: Subject to any disclaimer, the term of this patent is extended or adjusted under 35 U.S.C. 154(b) by 0 days.

(21) Appl. No.: 16/895,174

(22) Filed: Jun. 8, 2020

(65) Prior Publication Data

US 2020/0390254 A1 Dec. 17, 2020

Related U.S. Application Data

(60) Provisional application No. 62/861,381, filed on Jun. 14, 2019.

(51) Int. Cl.
*A47G 9/08* (2006.01)
*A41D 15/04* (2006.01)

(52) U.S. Cl.
CPC ..... *A47G 9/086* (2013.01); *A47G 9/08* (2013.01); *A41D 15/04* (2013.01)

(58) Field of Classification Search
CPC ..... A47G 9/086; A47G 9/08; A47G 2200/16; A47G 9/0223; A41D 15/04; A41D 15/05; A41D 15/005
See application file for complete search history.

(56) References Cited

U.S. PATENT DOCUMENTS

| | | | | |
|---|---|---|---|---|
| 5,735,003 | A | 4/1998 | Judge | |
| 6,175,976 | B1 * | 1/2001 | Cantwell | A47G 9/086 5/413 R |
| 6,216,290 | B1 * | 4/2001 | Zemitis | A47G 9/086 112/475.08 |
| 6,428,774 | B1 | 8/2002 | Michaelis et al. | |
| 6,438,774 | B1 * | 8/2002 | Michaelis | A47G 9/086 2/69.5 |
| 7,631,376 | B2 | 12/2009 | Peterson et al. | |
| 7,650,655 | B2 | 1/2010 | Narboni-Campora | |
| 7,849,534 | B2 | 12/2010 | Bellick et al. | |
| 8,499,381 | B1 | 8/2013 | Miller et al. | |
| 9,408,484 | B2 | 8/2016 | Schofield et al. | |
| 10,512,344 | B2 | 12/2019 | Brensinger et al. | |
| 2014/0366269 | A1 | 12/2014 | Brensinger et al. | |

FOREIGN PATENT DOCUMENTS

| | | |
|---|---|---|
| WO | 2001074203 | 10/2001 |

* cited by examiner

*Primary Examiner* — David R Hare
*Assistant Examiner* — Madison Emanski
(74) *Attorney, Agent, or Firm* — Holzer Patel Drennan

(57) ABSTRACT

A sleeping bag that provides a user a greater amount of room, on demand, within the interior of the sleeping bag by including at least one expandable panel. The expandable panel has an "open" position and a "closed" position. In the open position, the panel is expanded providing an increased girth and interior volume to the sleeping bag, compared to when the panel is closed. The expandable panel may have a reduced amount of insulation compared to the rest of the sleeping bag.

19 Claims, 7 Drawing Sheets

FIG. 3A
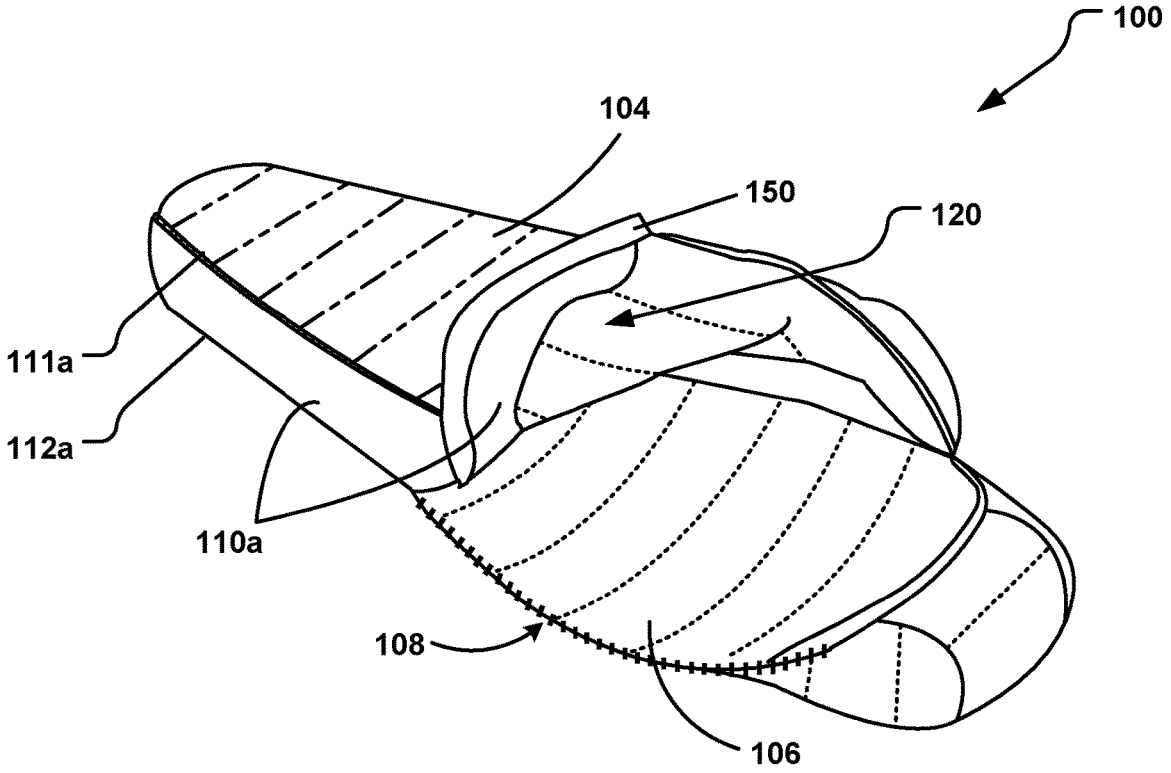
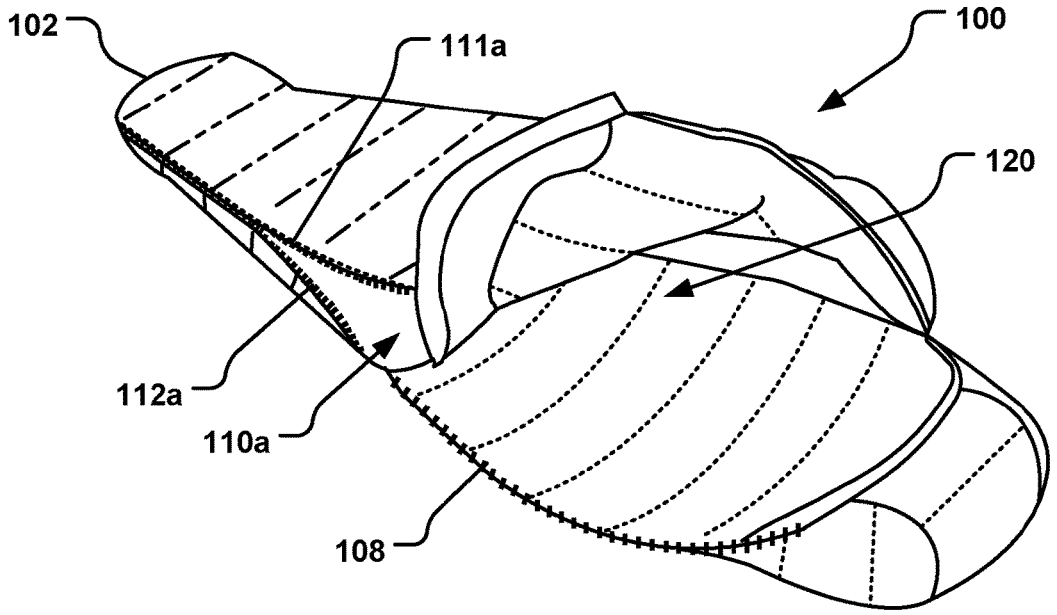
FIG. 3B

SLEEPING BAG WITH EXPANSION PANEL

CROSS-REFERENCE

This application claims priority to U.S. Provisional Patent Application No. 62/861,381 filed Jun. 14, 2019 and titled "Sleeping Bag with Expansion Panels," the entire disclosure of which is incorporated herein by reference for all purposes.

BACKGROUND

Camping is currently enjoying a surge in popularity as the population, in general, is spending more time outdoors connecting with nature. There are many different ways in which people like to camp. Some campers carry their equipment to remote places and desire light and easily packed equipment, while at the other end of the spectrum, other campers 'camp' in established tents that have beds, electricity and many conveniences of a hotel (e.g., "glamping"). Between these two types of campers are those who camp alongside or close to their vehicles; these campers desire comfort without extravagance. No matter what type of camper, they all have high desires for comfort and convenience while camping, and a large demand exists for products that can provide high levels of both.

For many campers, getting a good night's sleep can be difficult due to many different factors. Not only is the surface (e.g., cot, foam pad, blow-up pad, directly on the ground) upon which a camper sleeps very important in determining the level of comfort and the resulting quality of sleep, the physical constraint is also paramount to sleeping well. Some campers enjoy being bundled tightly in a sleeping bag, whereas others desire more interior volume to allow for increased freedom of movement while in the sleeping bag.

Further, the temperature during sleep highly affects the camper's comfort. Most sleeping bags are rated for a temperature range-of-use, e.g., 20° C., 40° C., 0° C., etc., based on the amount of insulation in the bag. For many campers, this rating does not align with their body temperature or their desired sleeping temperature; also, the desired temperature changes overnight for many campers.

SUMMARY

The sleeping bag described herein provides a user (e.g., camper) a greater range of interior volume, while within the sleeping bag, by including at least one expandable panel. Additionally, the at least one panel may provide temperature adjustment due to having a reduced amount of insulation at that location compared to the rest of the sleeping bag. The panel has an "open" position and a "closed" position; in the open position, the panel is expanded, providing an increased sleeping bag girth that results in increased interior volume. Also in the open position, the panel section of the sleeping bag provides an area of the sleeping bag having a reduced amount of insulation, whereas in the closed position, the panel with the reduced amount of insulation is not exposed to the outside of the bag, thus no insulation reduction is realized. When two panels are present, they can be positioned at opposite sides of the sleeping bag, between the top sheet and the bottom sheet. The panel(s) may extend the entire length of the sleeping bag.

In one particular embodiment, described herein, a sleeping bag having an insulated top sheet panel, an opposite insulated bottom sheet panel and at least one expandable panel, with the top sheet panel, the bottom sheet panel and the at least one expandable panel defining an interior and an interior volume. The at least one expandable panel may be an insulated panel with the same or less insulation than the top insulated sheet and/or the bottom insulated sheet.

The sleeping bag can have two opposite expandable panels.

When the at least one expandable panel is closed, the interior has a first volume, and when the at least one expandable panel is open, the interior has a second volume greater than the first volume. In other words, opening the panel increases the interior volume available to the user. Similarly, when the at least one expandable panel is closed, the sleeping bag has a first girth, and when the at least one expandable panel is open, the sleeping bag has a second girth greater than the first girth. In other words, opening the panel increases the circumference of the bag.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. These and various other features and advantages will be apparent from a reading of the following Detailed Description.

BRIEF DESCRIPTIONS OF THE DRAWING

The disclosure may be more completely understood in consideration of the following detailed description of various embodiments of the disclosure in connection with the accompanying drawing, in which:

FIG. 3A is a perspective view of the sleeping bag of FIG. 1 showing the interior of the sleeping bag with at least one side expansion panel open; FIG. 3B is a perspective view of the sleeping bag of FIG. 1 and FIG. 3A showing the interior of the sleeping bag with the side expansion panel partially open.

DETAILED DESCRIPTION

Figure 1:
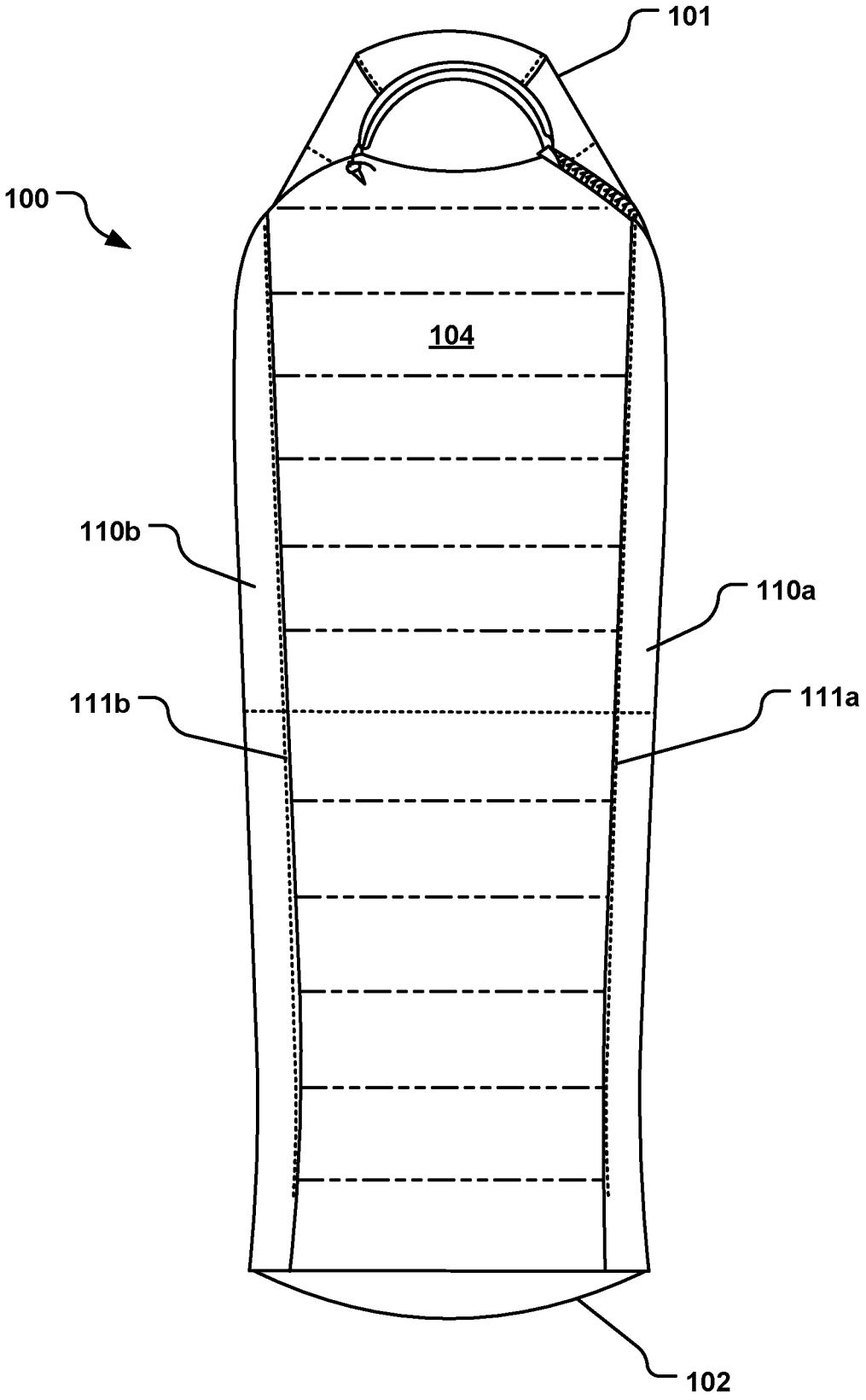
FIG. 1 is a plan view of the front side of a sleeping bag with side expansion panels open.

Described herein are sleeping bags that include at least one expandable panel extending along a length of the sleeping bag, the expandable panel allowing the user to adjust the interior volume of the sleeping bag. In some embodiments, the expandable panel can be a temperature adjustment feature, allowing the user to adjust the temperature within the interior of the sleeping bag, due to the increased interior volume and optionally a reduced amount of insulation in the expandable panel.

Although sleeping bags do come in various sizes (e.g., length, width) and various temperature ratings, these are standard sizes and standard temperature ratings and a sleeping bag may not be optimal for every user. The sleeping bags described herein allow a user to adjust the size or girth, and thus the interior volume, of the sleeping bag, creating a custom fit with a desired amount of physical constraint.

A sleeping bag keeps a user warm because the shell, lining and insulation create a barrier to prevent loss of the heat that the body's metabolism produces. However, the more space between the user's body and the barrier of the sleeping bag, the more energy is required to heat that space or volume. Conversely, when the space is smaller, it requires less energy to heat that space or volume. By changing the interior space or volume of the sleeping bag, the sleeping bag can be tailored to the particular user and their desired temperature. Because the sleeping bags described herein allow a user to adjust the interior volume, they also allow the user to create a personalized microclimate depending on their preference and depending on the outside temperature.

In the following description, reference is made to the accompanying drawing that forms a part hereof and in which are shown by way of illustration at least one specific embodiment. In the drawing, like reference numerals are used throughout several figures to refer to similar components. In some instances, a reference numeral may have an associated sub-label consisting of a lower-case letter to denote one of multiple similar components. When reference is made to a reference numeral without specification of a sub-label, the reference is intended to refer to all such multiple similar components.

Figure 2A:
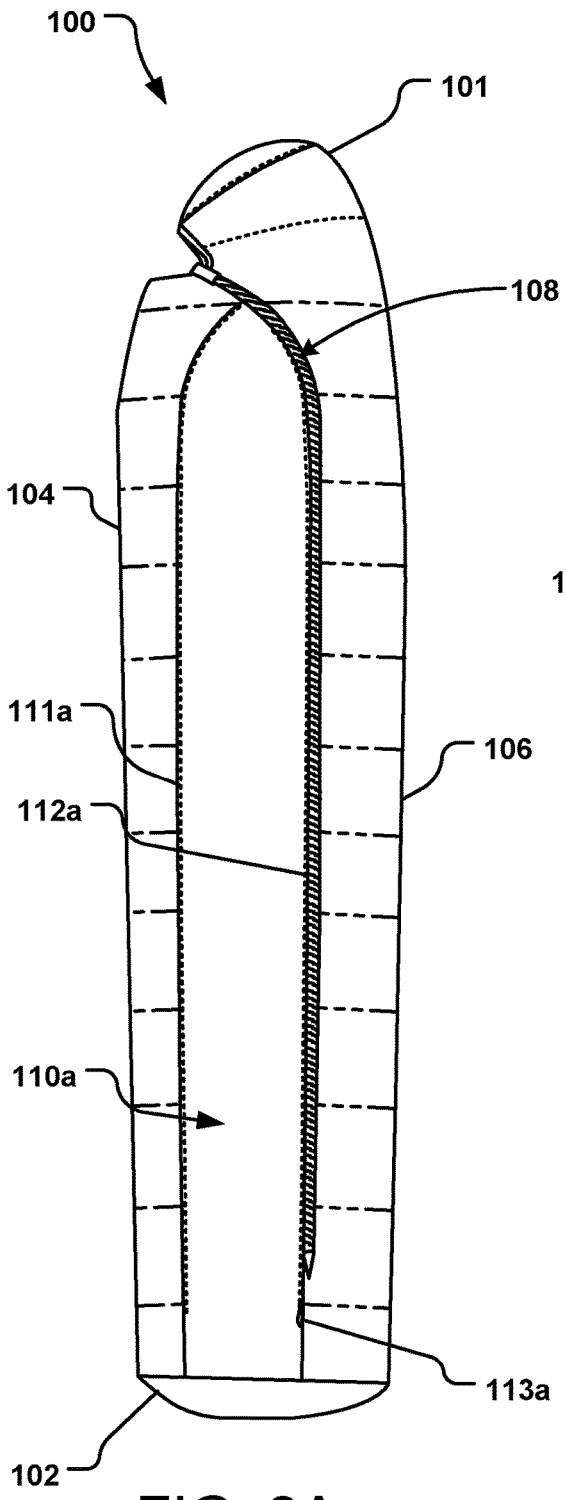
FIGS. 2A and 2B are plan views of the left and right sides, respectively, of the sleeping bag of FIG. 1, shown with side expansion panels open.
Figure 2B:
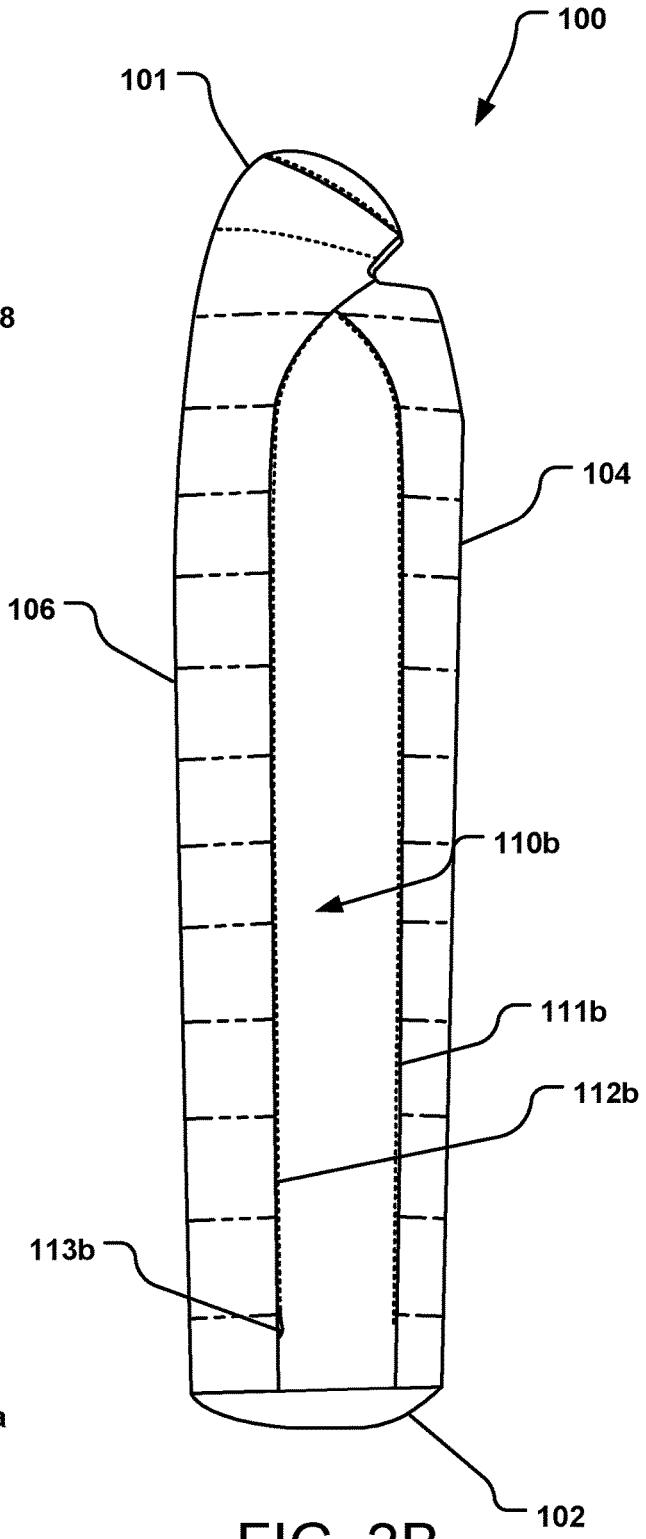

Referring to FIG. 1 and to FIGS. 2A and 2B, a sleeping bag 100 is shown having at least one expandable panel 110 extending a length of the bag 100. The sleeping bag 100 may be a mummy-style bag, a basic rectangular bag, or any shape and style therebetween.

The sleeping bag 100 has a first end 101 at which the user's head is positioned (when the sleeping bag is properly in use) and a second end 102 at which the user's feet are positioned (when the sleeping bag is properly in use); in this example, the bag 100 has an integrated hood at the first end 101. In the particular bag 100 shown, the sleeping bag 100 has a left side expandable panel 110*a* and a right side expandable panel 110*b*, the expandable panels 110 located on opposite lateral sides of the bag 100. In this embodiment, the expandable panels 110 are located directly across from each other on each side of the sleeping bag 100. The panels 110 extend at least partially between the first end 101 and the second end 102, or, they extend at least partially from the head end of the bag to the foot end.

The sleeping bag 100 has a common construction including a top sheet panel 104, a bottom sheet panel 106 and an interior volume (not seen in FIG. 1, 2A or 2B) to receive and accommodate a user therein. The top sheet panel 104 and the bottom sheet panel 106 each have an outer shell, and inner lining, and insulation therebetween; additional details regarding the sheet panels are provided below. The sleeping bag 100 has a zipper 108, seen in FIG. 2A, to provide access to the interior of the sleeping bag 100; the access zipper 108 is a conventional zipper, having two mating, elongate extensions. The zipper 108 may be referred to as a main zipper or an access zipper. The zipper 108 may be located at a side of the bag 100, as shown in FIG. 2A, or may be present at a different location, e.g., centrally located in the top sheet 10-4.

Further, each expandable panel 110 has a zipper having two engaging zipper elements 111, 112, one of the elements 111, 112 at each edge of the panel 110, and a zipper slider 113 to engage and disengage the elements 111, 112; the panel 110*a* has a first zipper element 111*a*, a second zipper element 112*a* and a zipper slider 113*a*, and the panel 110*b* has a first zipper element 111*b*, a second zipper element 112*b* and a zipper slider 113*b*. When the zipper elements 111, 112 of each panel 110 are engaged (e.g., zipped via the slider 113), the panel 110 is closed or unexpanded, whereas when the zipper elements 111, 112 are not engaged (e.g., open or unzipped), the panel 110 is open or expanded. The zippers elements 111, 112 have an extended length and may be full engaged, partially engaged/partially unengaged, or fully unengaged along their length. In some implementations, the zipper with the elements 111, 112 may be a two-way zipper, allowing independent opening from both ends.

The panels 110 and thus zipper elements 111, 112 may extend the entire length of the length of the bag 100 from the first end 101 to the second end 102, or may stop short of either end; typically, the panel 110 and thus zipper elements 111, 112 will not be present in any hood. In some embodiments, the zipper elements 111, 112 may not extend the entire length of the expandable panel 110; for example, in FIGS. 2A and 2B, the zipper elements 111, 112 do not extend to the end of the expandable panels 110 at the second end 102, as evidenced by the zipper slider 113 seen on the zipper element 112. In some embodiments, the zipper elements 111, 112 are present the same length as the main zipper 108; FIG. 2A shows an embodiment where the zipper elements 111, 112 are longer than the main zipper 108.

FIGS. 3A and 3B also show the sleeping bag 100 with the expandable panels 110 and show the interior of the bag 100; the interior is shown as 120. The interior 120 is the volume in which a user resides, when the bag is properly used.

In FIG. 3A, similar to FIGS. 1, 2A and 2B, the expandable panel 110*a* is shown open or expanded, with the zipper elements 111*a*, 112*a* not engaged. In FIG. 3B, the expandable panel 110*a* is shown partially open and partially closed, with the zipper elements 111*a*, 112*a* engaged for a portion of the length, particularly, engaged proximity the foot end or the second end 102. When the expandable panel 110 is closed or partially closed, the closed portion of the panel 110 folds inward, e.g., as a gusset.

When the expandable panel 110 is closed, the interior has a first volume, and when expandable panel is open, the interior has a second volume greater than the first volume; this is due to the increased girth of the sleeping bag which is a result of the expanded panel.

In some embodiments, the panel 110 has an expanded width of at least 2 inches (i.e., the spacing between the two zipper elements 111, 112 is at least 2 inches when unzipped), in other embodiments at least 3 inches, or at least 4 inches, or at least 5 inches, or at least 6 inches; thus, the sleeping bag 100 would have an increase in girth of at least 2 inches, or at least 3 inches, or at least 4 inches, or at least 5 inches, or at least 6 inches when the panel 110 is unzipped or expanded compared to when the panel 110 is closed. If the sleeping bag 100 has two expandable panels 110 that are the same size, the increase in girth would be double, at least 4 inches, or at least 6 inches, or at least 8 inches, or at least 10 inches, or at least 12 inches when both of the panels 110 are unzipped or expanded compared to when both of the panels 110 are closed. Because the volume of the interior 120 is dependent on the girth, the volume of the interior 120 will likewise increase.

The width of the expandable panel 110 may be the same its entire length or may taper or otherwise change width along its length. For example, the panel 110 may provide more expansion at the user's shoulders than at the feet, or may provide more expansion at the feet, such as for a mummy-style bag. As another example, the panel 110 may provide more expansion at the location of the user's hips than at the shoulders and the feet.

Figure 4:
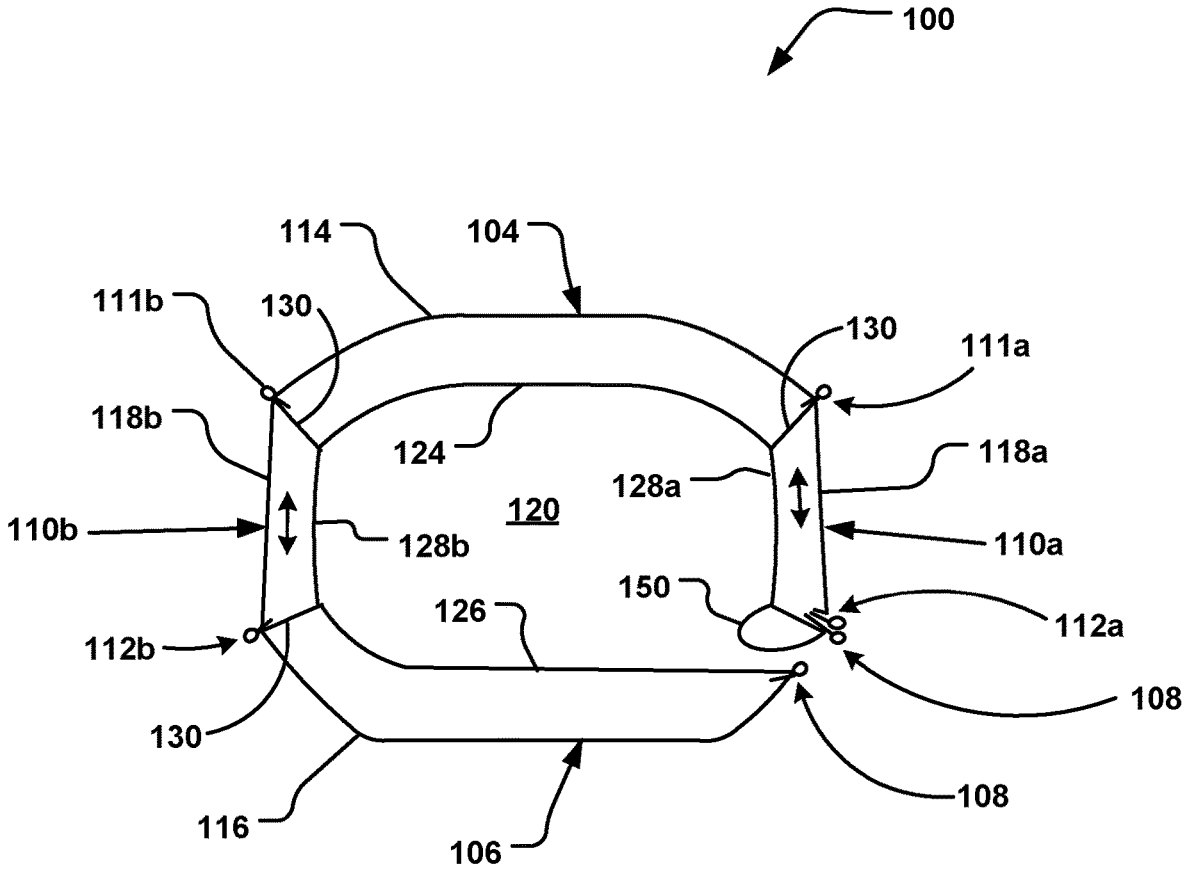
FIG. 4 is a schematic cross-section of the sleeping bag of the previous figures, with the side expansion panels open, seen from the foot end of the sleeping bag.

FIG. 4 illustrates details of the construction of the sleeping bag 100, with a portion of the bag 100 shown in cross-section, the view taken from the second or foot end of the sleeping bag 100. In FIG. 4, the two expandable panels 110*a*, 110*b* are shown expanded.

Shown in FIG. 4 are the top sheet panel 104 and the opposite bottom sheet panel 106; these sheet panels 104, 106 have an amount of insulation therein (the amount of insulation may be the same or different between the two sheet panels 104, 106). The insulated sheet panels 104, 106 together with the expandable panel(s) 110 define the interior 120.

The top sheet panel 104 has an outer shell 114 and an inner lining 124 between which is located an amount of insulation (not seen); similarly, the bottom sheet panel 106 has an outer shell 116 and an inner lining 126 between which is located an amount of insulation (not seen). Similar to the sheet panels 104, 106, each of the expandable panels 110 (e.g., the left side panel 110*a* (which is on the right side of FIG. 4) and the right side panel 110*b* (which is on the left side of FIG. 4)) has an outer extension shell 118 and an inner panel lining 128 between which is located an amount of insulation (not seen).

The divisions between the expandable panels 110 and the sheet panels 104, 106 can be defined by an extension of material (e.g., a baffle) 130 extending from the outer materials (e.g., shells 114, 116 and extension shell 118) and the lining (e.g., inner lining 124, 126 and inner panel lining 128). In such a construction, either or both the outer materials (e.g., shells 114, 116) and the lining (e.g., inner lining 124, 126) may be continuous with the outer extension shell 118 and/or the inner panel lining 128, with the extension 130 connected to the outer material and/or lining. Alternately, either or both the outer materials (e.g., shells 114, 116) and the lining (e.g., inner lining 124, 126) may terminate at the extension 130, where the extension shell 118 and/or the inner panel lining 128 then begin. In some embodiments, two extensions 130 may be present at each location; this may facilitate manufacture of the bag. As an example, each of the sheet panel 104, the sheet panel 106, and the at least one expandable panel 110 can be made separately as in individual piece and the individual pieces are subsequently stitched together to eventually form the sleeping bag 100.

Alternately, the divisions between the expandable panels 110 and the sheet panels 104, 106 may be merely a connection (e.g., stitching) directly connecting the outer materials (e.g., shells 114, 116 and outer extension shell 118) to the lining (e.g., inner lining 124, 126 and inner panel lining 128), through any insulation.

The material for the outer extension shell 118 can be the same or different than the material of the outer shell 114, 116. The material for the inner panel lining 128 can be the same or different material than the inner lining 124, 126, although in most embodiments is the same. The amount of insulation in the expandable panels 110 can be, and typically is, less than the amount of insulation in one or both of the sheet panels 104, 106. The amount of insulation in the expandable panels 110 may be, e.g., at least 10% less than in one or both of the sheet panels 104, 106, in other embodiments at least 20% less. When described herein that the expandable panels 110 have less insulation than the sheet panels 104, 106, what is intended is that the expandable panels 110 have less insulative properties than the sheet panels 104, 106 at the same longitudinal location relative to the first end 101 and the second end 102.

The expandable panels 110 are opened and closed via the zipper elements 111, 112, as seen, for example, in FIG. 3B. In FIG. 4, the zipper elements 111, 112 are unengaged (specifically, the zipper element 111*a* is unengaged from the zipper element 112*a*, and the zipper element 111*b* is unengaged from the zipper element 112*b*) so that the panels 110*a*, 110*b* are expanded or open. When the panels 110 are expanded, as in FIGS. 1, 2A, 2B, 3A and 4, the panels 110 provide an increased circumference or girth to the bag 100 at the longitudinal location between the first end 101 and the second end 102 wherein the zipper elements 111, 112 are open. Additionally, if less insulation is present in the expandable panels 110 than in the sheet panels 104, 106, the expanded panels 110 potentially provide a cooling of the interior 120 of the bag 100.

The insulation in the sleeping bag 100, in any or all of the sheet panels 104, 106 and the expandable panels 110, may be any insulation suitable for sleeping bags, including natural insulation such as down and synthetic insulation such as polyester fill and insulations available under the tradenames POLARGUARD, POLARGUARD DELTA, QUALLOFIL, HOLLOFIL, and THERMOLITE.

Figure 5:
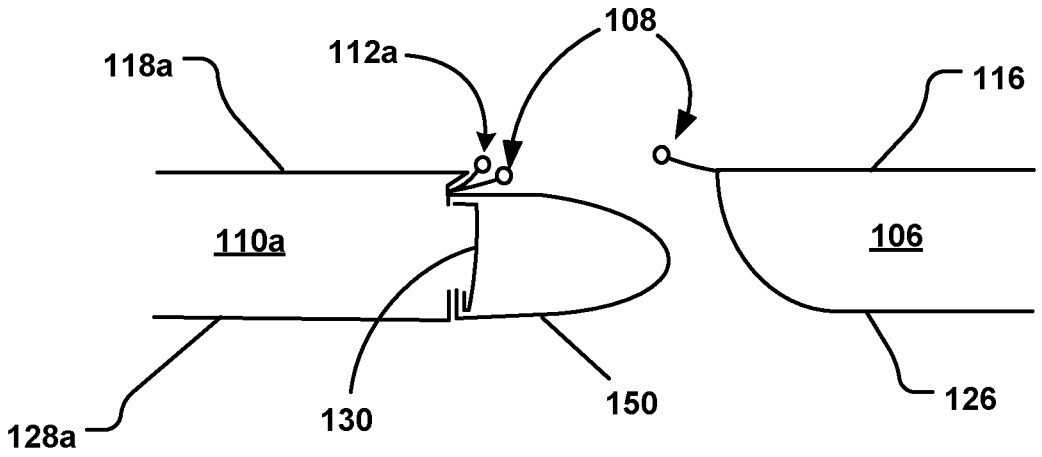
FIG. 5 is an enlarged schematic cross-section of a draft tube of the sleeping bag of the previous figures.

Seen in FIG. 4 and also in FIG. 3A, the sleeping bag 100 includes a draft tube 150 proximate the main zipper 108, to inhibit drafts from entering to the interior 120 through the zipper 108. Draft tubes, in general, are known in sleeping bags. FIG. 5 illustrates an enlarged construction of the draft tube 150 from FIG. 4.

In this particular embodiment, because the main zipper 108 is adjacent to an expansion panel 110, the draft tube 150 is adjacent to the expansion panel 110. In other embodiments, the main zipper 108 and draft tube 150 may be removed from an expansion panel 110.

Figure 6:
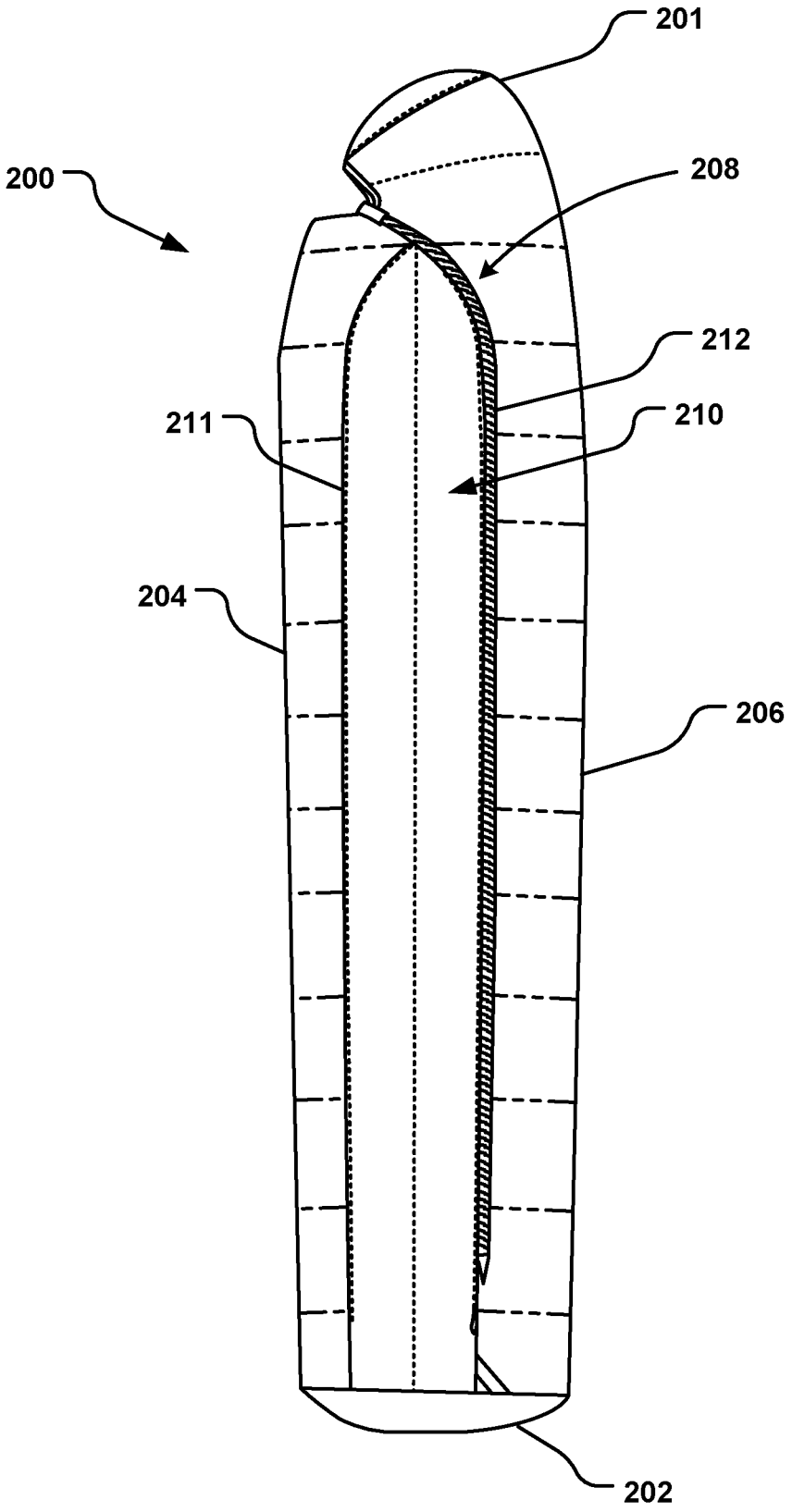
FIG. 6 is a left side plan view of a sleeping bag with a side expansion panel open.

FIG. 6 shows an alternate embodiment of a sleeping bag, similar to the sleeping bag 100. In FIG. 6, a sleeping bag 200 has a first end 201 at which the user's head is positioned (when the sleeping bag is properly in use) and a second end 202 at which the user's feet are positioned (when the sleeping bag is properly in use). The sleeping bag 200 has a shell including a top sheet panel 204 and a bottom sheet panel 206 and an interior volume to receive a user therein. The sleeping bag 200 has a zipper 208 to provide access to the interior of the sleeping bag 200. The bag 200 has at least one expandable panel 210, which may have a reduced amount of insulation therein; the expandable panel 210 is including a first zipper element 211 and a second zipper element 222. In the sleeping bag 200, the expandable panel 220 has a tapered width (the width being measured from the top sheet panel 204 to the bottom sheet panel 206).

In this sleeping bag 200, the expandable panel 210 has an expanded width that varies along the length of the bag 200, from the head end 201 to the foot end 202. As an example, at the foot end 202 the panel 210 expands to provide an increase of 5 inches to the girth of the bag 200, whereas proximate the head end 201 the panel 210 expands to provide an increase of 7 inches to the girth of the bag 200. When two panels 210 are present and expanded, the girth increase is 10 inches at the foot end 202 and 14 inches at the head end 201.

Figure 7A:
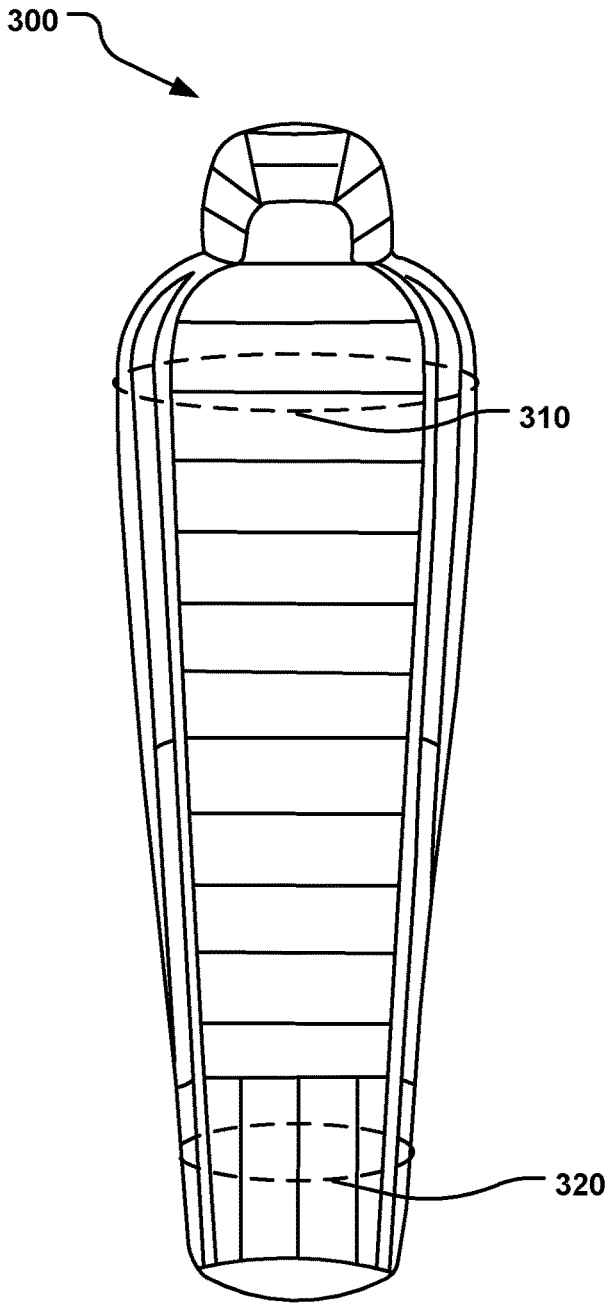
FIG. 7A is a plan view of the front side of a sleeping bag having side expansion panels, with the panels unexpanded.
Figure 7B:
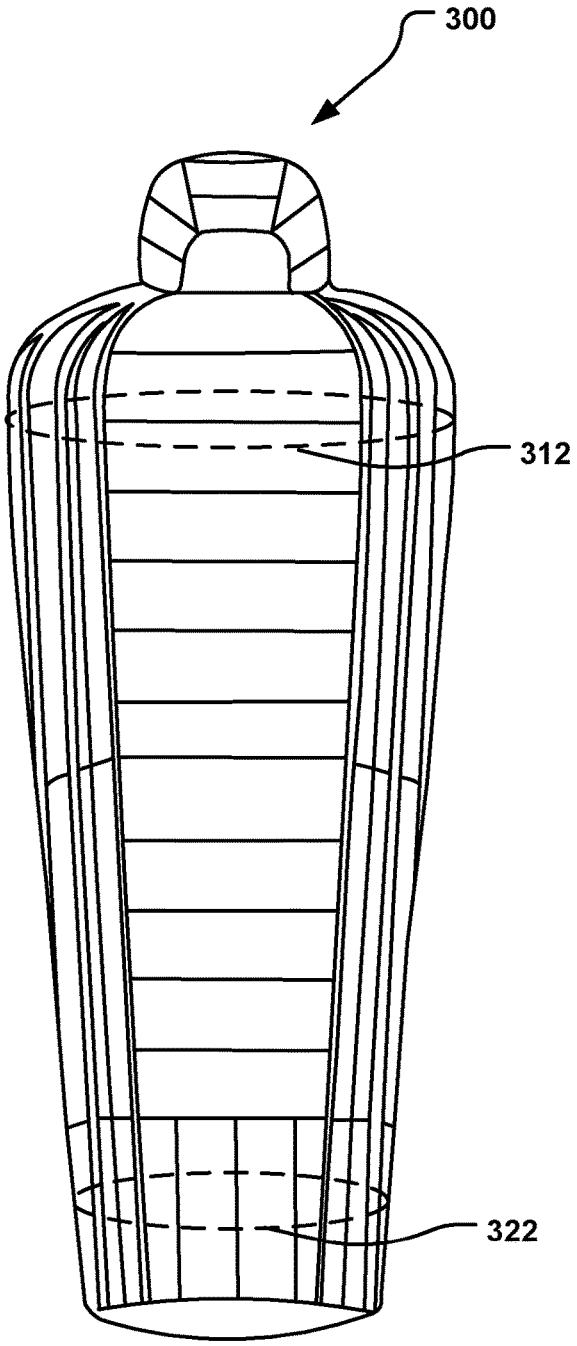
FIG. 7B is a plan view of the front side of the sleeping bag of FIG. 7A having side expansion panels expanded.

FIGS. 7A and 7B show an example sleeping bag 300 having two expandable panels, one at each side. In FIG. 7A, the expandable side panels are zipped, closed or unexpanded, thus showing the bag 300 having a first volume. In FIG. 7B, the expandable side panels are unzipped, open or expanded, thus showing the bag 300 having a second volume greater than the first volume. As seen in FIG. 7A, in the unexpanded state, the bag 300 has a girth 310 proximate the head end of the bag 300 and a girth 320 proximate the foot end of the bag 300. In FIG. 7B, in the expanded state, the bag 300 has a girth 312 proximate the head end of the bag 300 and a girth 322 proximate the foot end of the bag 300. It is readily seen that the expanded girth 312, 322 is greater than the unexpanded girth 310, 320, due to the expansion of the two expandable panels.

The above specification, together with the figures, provides a complete description of the structure and use of exemplary embodiments of the invention. The above description provides specific embodiments. It is to be understood that other embodiments are contemplated and may be made without departing from the scope or spirit of the present disclosure. The above detailed description, therefore, is not to be taken in a limiting sense. For example, the sleeping bag may be a "mummy" style bag, a bag with or without an integrated hood, a bag tapering in width from the first (head) end to the second (foot) end, or a simple rectangular bag. Different bags may have the expansion panel(s) at a location other than the side of the bag, for example, slightly higher towards the chest or centerline of the bag than shown (e.g., a few inches). While the present disclosure is not so limited, an appreciation of various aspects of the disclosure will be gained through a discussion of the examples provided.

As used herein, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

Spatially related terms, including but not limited to, "lower", "upper", "beneath", "below", "bottom", "above", "on top", "top", etc., if used herein, are utilized for ease of description to describe spatial relationships of an element(s) to another. Such spatially related terms encompass different orientations of the device in addition to the particular orientations depicted in the figures and described herein. For example, if a structure depicted in the figures is turned over or flipped over, portions previously described as below or beneath other elements would then be above or over those other elements.

Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A sleeping bag having a top insulated sheet panel, an opposite bottom insulated sheet panel and two expandable panels, the top panel, the bottom panel, and the two expandable panels having a length extending longitudinally from a first end of the sleeping bag to a second end, wherein the first end is a head end and the second end is a foot end, the expandable panels each having a zipper, with each zipper having a first zipper end and a second zipper end defining a zipper length, and each zipper having a first zipper element engageable with a second zipper element extending the zipper length of the zipper, wherein each zipper extends the length of the expandable panels from the first end to the second end;

the top sheet panel, the bottom sheet panel and the expandable panels defining an interior, wherein:

when the first and second zipper elements of both zippers are fully engaged along the zipper lengths, the expandable panels have a closed orientation providing a first interior volume and a first girth at the first end and a first girth at the second end, and when the first and second zipper elements of both zippers are fully unengaged along the zipper lengths, the expandable panels have an open orientation providing a second interior volume greater than the first interior volume and a second girth at the first end and a second girth at the second end, both second girths greater than the respective first girths.

2. The sleeping bag of claim 1 further having a main access zipper to provide access to the interior.

3. The sleeping bag of claim 2 further having a draft tube proximate the main access zipper.

4. The sleeping bag of claim 1, wherein the expandable panels are situated on opposite sides of the sleeping bag.

5. The sleeping bag of claim 1, wherein each zipper of the expandable panels has the first zipper element at a first edge of the expandable panel and the second zipper element at a second edge of the expandable panel.

6. The sleeping bag of claim 1, wherein the second girth at the first end is at least four inches greater than the first girth at the first end and the second girth at the second end is at least four inches greater than the first girth at the second end.

7. The sleeping bag of claim 1, wherein the expandable panels are insulated expandable panels.

8. A sleeping bag having:

a top sheet panel comprising a top sheet outer shell and a top sheet inner lining with insulation therebetween;

an opposite bottom sheet panel comprising a bottom sheet outer shell and a bottom sheet inner lining with insulation therebetween; and at least one rectangular expandable panel comprising a panel outer shell having a first zipper element at a first edge of the panel outer shell and a second zipper element at a second edge of the panel outer shell, the first zipper element having a first zipper element first end and a first zipper element second end and the second zipper element having a second zipper element first end and a second zipper element second end, the at least one rectangular expandable panel further comprising a panel inner lining, wherein the top sheet panel, the bottom sheet panel and the at least one rectangular expandable panel have a length, wherein the first and second zipper elements extend the length of the at least one expandable panel from a first end at a head end of the sleeping bag to a second end at a foot end of the sleeping bag, the top sheet panel, the bottom sheet panel and the at least one rectangular expandable panel defining an interior volume of the sleeping bag, wherein:

when the first zipper element is engaged with the second zipper element from the first zipper element first end and the second zipper element first end to the first zipper element second end and the second zipper element second end, the sleeping bag has a first interior volume, and when the first zipper element is not engaged with the second zipper element from the first zipper element first end and the second zipper element first end to the first zipper element second end and the second zipper element second end, the sleeping bag has a second interior volume greater than the first interior volume.

9. The sleeping bag of claim 8 further having a main access zipper to provide access to the interior volume and a draft tube proximate the main access zipper.

10. The sleeping bag of claim 8 further having a second rectangular expandable panel comprising a second panel outer shell having a first zipper element at a first edge of the second panel outer shell and a second zipper element at a second edge of the second panel outer shell, the first zipper element having a first zipper element first end and a first zipper element second end and the second zipper element having a second zipper element first end and a second zipper element second end, and a second panel inner lining.

11. The sleeping bag of claim 10, wherein the rectangular expandable panels are situated on opposite sides of the sleeping bag.

12. The sleeping bag of claim 10, wherein each of the rectangular expandable panels is located between the top sheet panel and the bottom sheet panel.

13. The sleeping bag of claim 8, wherein:

when the first zipper element is engaged with the second zipper element from the first zipper element first end and the second zipper element first end to the first zipper element second end and the second zipper element second end, the sleeping bag has a first girth, and when the first zipper element is not engaged with the second zipper element from the first zipper element first end and the second zipper element first end to the first zipper element second end and the second zipper element second end, the sleeping bag has a second girth at least four inches greater than the first girth.

14. The sleeping bag of claim 8, wherein the at least one expandable panel further comprises insulation between the panel outer shell and the panel inner lining.

15. The sleeping bag of claim 14, wherein the insulation in the at least one expandable panel is less than the insulation in the top sheet panel and less than the insulation in the bottom sheet panel.

16. A sleeping bag having a head end and a foot end defining a length of the sleeping bag therebetween, the sleeping bag comprising:

a top sheet panel comprising a top sheet outer shell and a top sheet inner lining with insulation therebetween;

an opposite bottom sheet panel comprising a bottom sheet outer shell and a bottom sheet inner lining with insulation therebetween;

a first expandable panel having a length extending from the head end to the foot end and comprising a panel outer shell having a first zipper element at a first edge of the panel outer shell and a second zipper element at a second edge of the panel outer shell, the first zipper element having a first zipper element first end and a first zipper element second end and the second zipper element having a second zipper element first end and a second zipper element second end, the first zipper element and the second zipper element fully engageable and fully disengageable from the first zipper element first end and the first zipper element second end and the second zipper element first end and the second zipper element second end, wherein the first and second zipper elements extend the length of the first expandable panel, and a panel inner lining, the first expandable panel at a first side of the sleeping bag and having a same width at the head end as at the foot end; and a second expandable panel having a length extending from the head end to the foot end and comprising a second panel outer shell having another first zipper element at a first edge of the second panel outer shell and another second zipper element at a second edge of the second panel outer shell, the another first zipper element having an another first zipper element first end and an another first zipper element second end and the another second zipper element having an another second zipper element first end and an another second zipper element second end, the another first zipper element and the another second zipper element fully engageable and fully disengageable from the another first zipper element first end and the another first zipper element second end and the another second zipper element first end and the another second zipper element second end, wherein the first and second zipper elements extend the length of the second expandable panel, and a second panel inner lining, the second expandable panel at a second side opposite the first side of the sleeping bag and having a same second width at the head end as at the foot end, the top sheet panel, the bottom sheet panel, the first expandable panel and the second expandable panel defining an interior volume of the sleeping bag;

when the first zipper element of the first expandable panel and the second zipper element of the first expandable panel are engaged and the first another zipper element of the second expandable panel and the second another zipper element of the second expandable panel are engaged, the sleeping bag has a first foot end girth and a first head end girth, and when the first zipper element of the first expandable panel and the second zipper element of the first expandable panel are not engaged and the first another zipper element of the second expandable panel and the second another zipper element of the second expandable panel are not engaged, a second foot end girth is greater than the first foot end girth and a second head end girth is greater than the first head end girth.

17. The sleeping bag of claim 16, wherein the expandable panels extend longitudinally from the head end to the foot end of the sleeping bag.

18. The sleeping bag of claim 16, wherein the expandable panel further comprises insulation between the panel outer shell and the panel inner lining, and the second expandable panel comprises insulation between the second panel outer shell and the second panel inner lining.

19. The sleeping bag of claim 18, wherein the insulation in the expandable panels is less than the insulation in the top sheet panel and less than the insulation in the bottom sheet panel.

* * * * *